US006173752B1

(12) United States Patent
Nelson et al.

(10) Patent No.: US 6,173,752 B1
(45) Date of Patent: Jan. 16, 2001

(54) BAY WINDOW CORNICE DECORATING JOINT

(75) Inventors: Linda Mae Nelson; Judith A. Van Essen Kenyon; Patricia A. Lloyd, all of Scottsdale, AZ (US)

(73) Assignee: Create It Decor'g Inc., Scottsdale, AZ (US)

( * ) Notice: Under 35 U.S.C. 154(b), the term of this patent shall be extended for 0 days.

(21) Appl. No.: 09/376,646

(22) Filed: Aug. 18, 1999

(51) Int. Cl.[7] ..... E06B 9/00
(52) U.S. Cl. ..... 160/38; 160/19; 403/231
(58) Field of Search ..... 160/19, 38, 39; 403/231, 291

(56) References Cited

U.S. PATENT DOCUMENTS 2,862,549 * 12/1958 Robbins .
2,894,571 * 7/1959 Toti .
2,998,062 * 8/1961 Bixby .
5,144,997 * 9/1992 Marasco et al. .
5,152,331 * 10/1992 Barone .
5,345,990 * 9/1994 Potts .
5,361,821 * 11/1994 Barone .
5,505,245 * 4/1996 Badalamenti .
5,848,628 12/1998 Badalamenti ..... 160/38

FOREIGN PATENT DOCUMENTS

484783 * 10/1929 (DE) ..... 160/19
1442975 * 5/1966 (FR) ..... 160/39
1586398 * 2/1970 (FR) ..... 160/38
1443719 * 7/1976 (GB) ..... 160/38

* cited by examiner

*Primary Examiner*—Blair M. Johnson
(74) *Attorney, Agent, or Firm*—The Halvorson Law Firm, P.C.

(57) ABSTRACT

The present invention is a decorative assembly joint for decorative window treatments. The joint comprises a soft, moldable piece of material, preferably soft foam, that has a least one slit or angular cut on at least one side. These slits, or angular cuts, allows the joint to "move" or "give" to non-perpendicular angles typically found in bay window applications. Additionally, these slits or cuts further allow the joint to follow a curved window application, such as an eyebrow arch window application.

8 Claims, 5 Drawing Sheets

BAY WINDOW CORNICE DECORATING JOINT

FIELD OF THE INVENTION

The present invention relates to the field of window decorating systems. More specifically, the present invention relates to a cornice joint that is designed to be used to decorate bay window applications.

BACKGROUND OF THE INVENTION

Window treatments are commonly used to enhance the appearance of a window area. There have been a myriad of window treatment concepts and devices that have been proposed, and to some extent utilized. These devices are primarily for a traditional window that is flush with the wall that it is mounted within. Thus, perpendicular angles for cornice designs are appropriate and even desirable. However, there are many applications, such as bay windows and arched windows that require non-perpendicular angles. Thus, there exists a present and continuing need for a window treatment joint that is simple in design, inexpensive in construction, and amenable to use in association with a wide variety of window shapes, angles, and designs.

SUMMARY OF THE INVENTION

It is an object of the present invention to provide a device that provides non-perpendicular angles for a cornice window treatment system necessitated by applications, such as bay windows.

It is another object of the present invention to provide a device that provides smooth continuous curved cornice treatments necessitated by applications, such as an eyebrow arch treatment for arched windows.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF THE PREFERRED EMBODIMENTS

Figure 1:
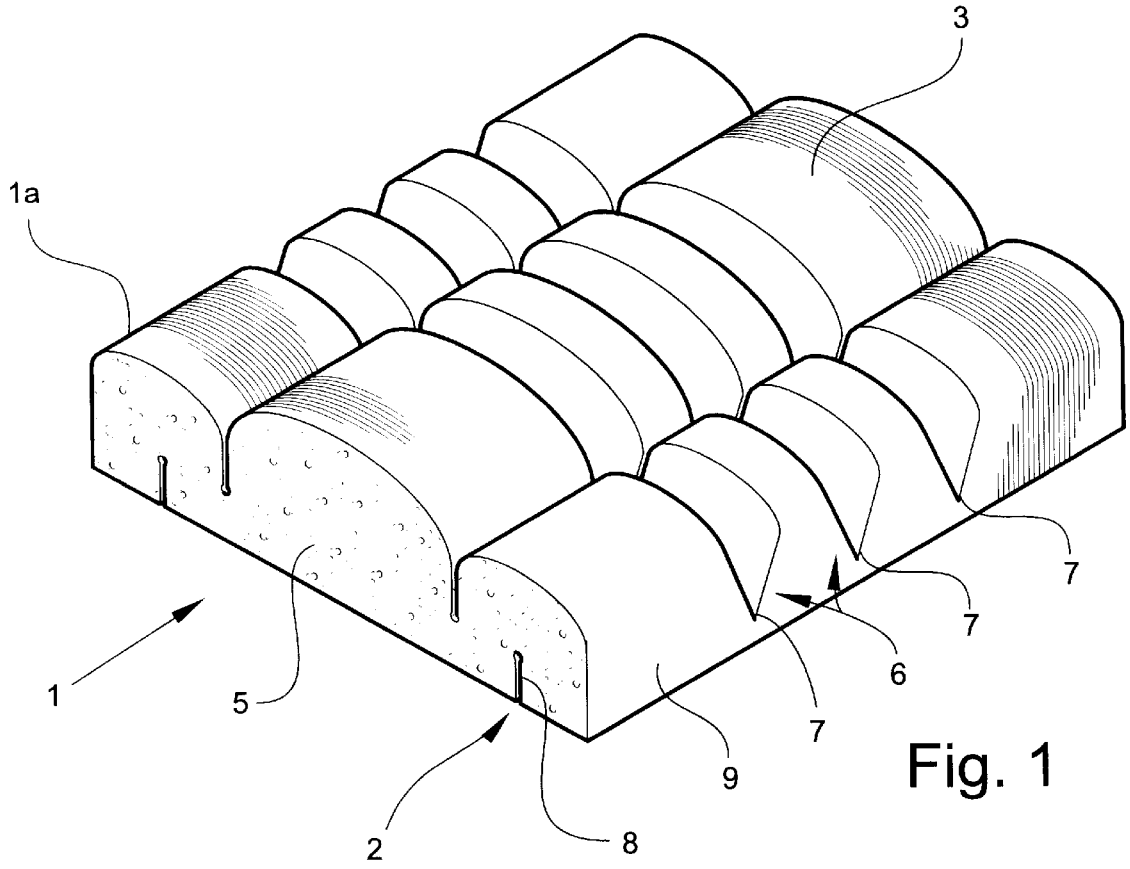
FIG. 1 is a perspective view of the joint for a cornice channel body according to the present invention.

The present invention is a decorative assembly joint 1 for window decorative treatments, such as cornices. The joint 1 comprises a soft, moldable piece of material, preferably soft foam, that has a bottom 2, a top 3, two sides 4, and two ends 5. There is at least one slit 6, or angular cut(s), with an incised angle 7 incised into either to top 3 or the bottom 2 of the joint 1 to allow for increased bending, or flexibility, over that provided by the inherent properties of the soft foam. The at least one slit 6 is incised perpendicular to a longitudinal direction defined as extending between the two ends 5.

The at least one slit 6 allows the joint to "move" or "give" to non-perpendicular angles typically found in bay window applications without having gaps or open spaces in the cornice treatment. Additionally, incorporating multiple slits 6 allows the joint 1 to smoothly follow a curved application, such as for an arched window. The at least one slit 6 is preferably incised into the top surface 3, however, they may be incised in the bottom surface 2 or both, 2 and 3, and still fall within the scope of the present invention.

The angle of the incised slits 6 should vary with the number of incised slits 6. If there is only a single slit 6, then the incised angle should approximate a 90 degree angle. If there are more than a single slit, then the incised angle should be less than 90 degrees. One possible organization of slits 6 is to have the sum of all of the angles of the incised slits 6 equal approximately 90 degrees. Other incised angle algorithms may be used and still fall within the scope of the present invention.

Incised into the bottom 2 of the joint 1 are at least one, but may be two or more, fabric receiving channels 8. These channels 8 are used when decorating the joint 1 by wrapping the joint 1 with fabric and inserting opposite edges of the fabric into the channels 8. Furthermore, in an alternate embodiment, the top 3 of the joint 1 may also have a large longitudinally extending channel 9 that is for receiving a second, smaller, inserted joint. When used thusly, each of the two joints may be decorated with different fabrics or patterns to provide a variety of different complimentary and/or contrasting looks.

Figure 2:
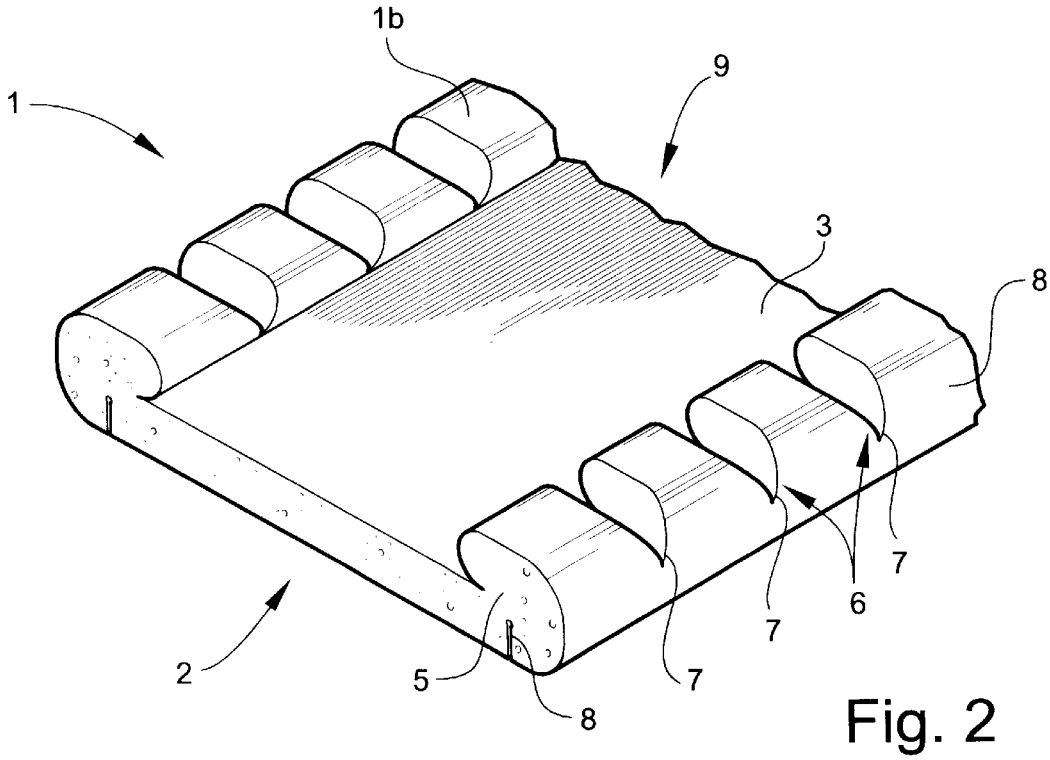
FIG. 2 is a perspective view of the joint for a cornice relief body according to the present invention.
Figure 3:
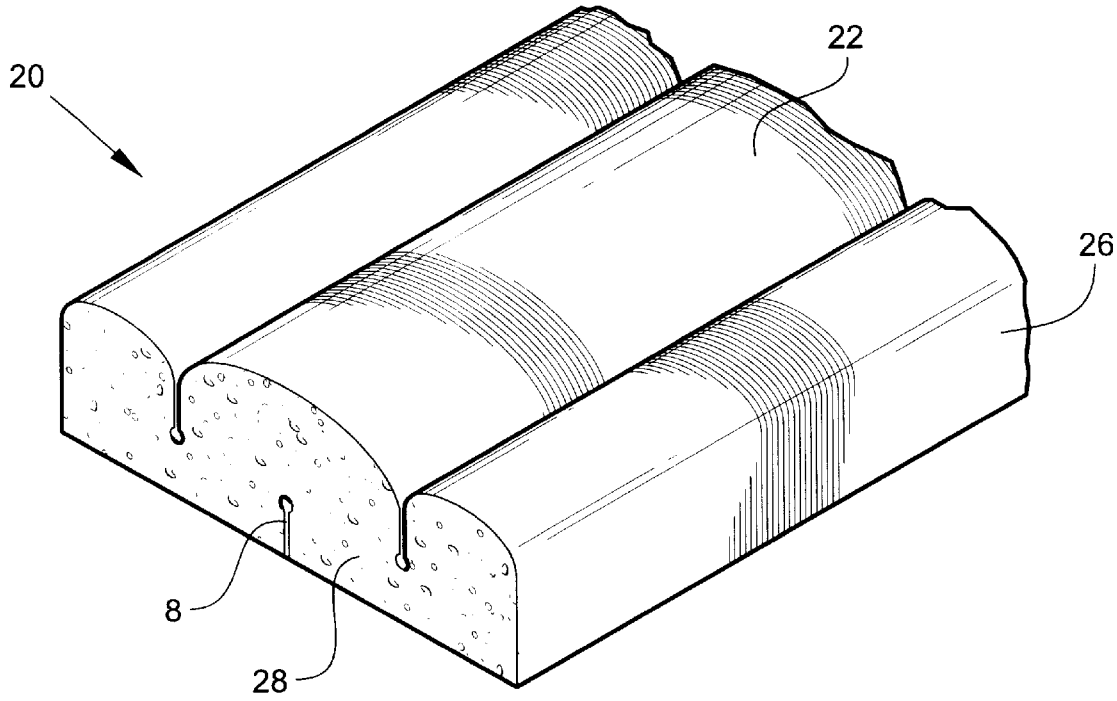
FIG. 3 is a perspective view of a cornice relief body according to the present invention.
Figure 4:
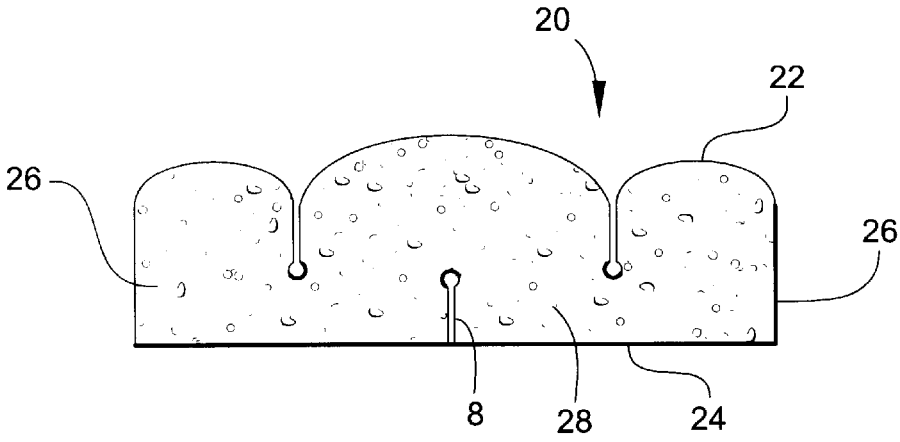
FIG. 4 is an end view of the cornice relief body according to the present invention.
Figure 5:
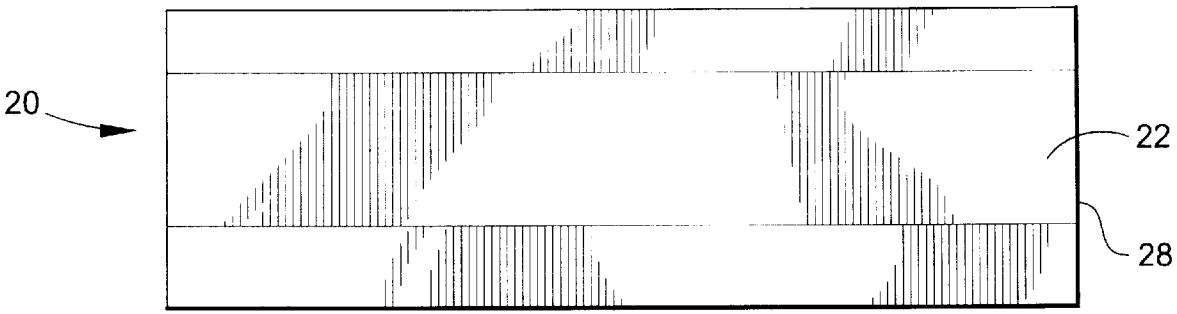
FIG. 5 is a top view of the cornice relief body according to the present invention.
Figure 6:
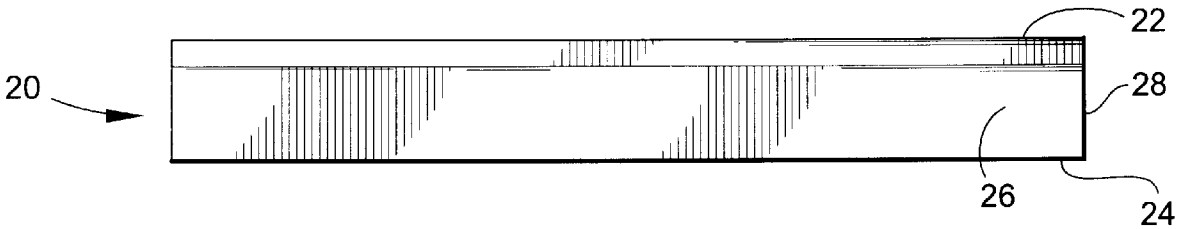
FIG. 6 is a side view of the cornice relief body according to the present invention.
Figure 7:
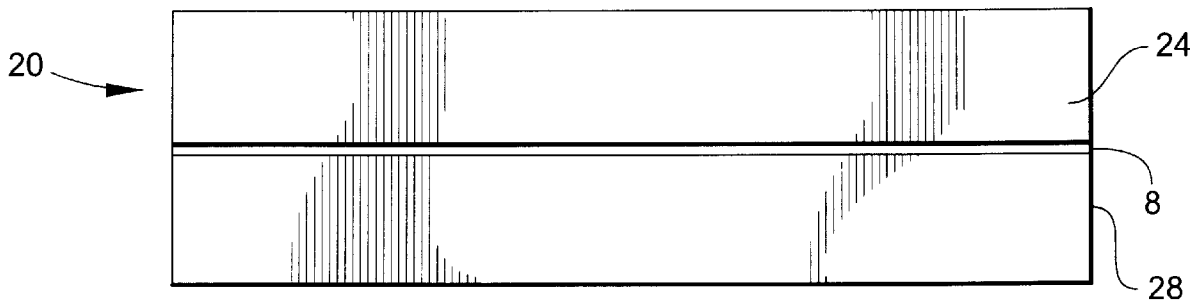
FIG. 7 is a bottom view of the cornice relief body according to the present invention.
Figure 8:
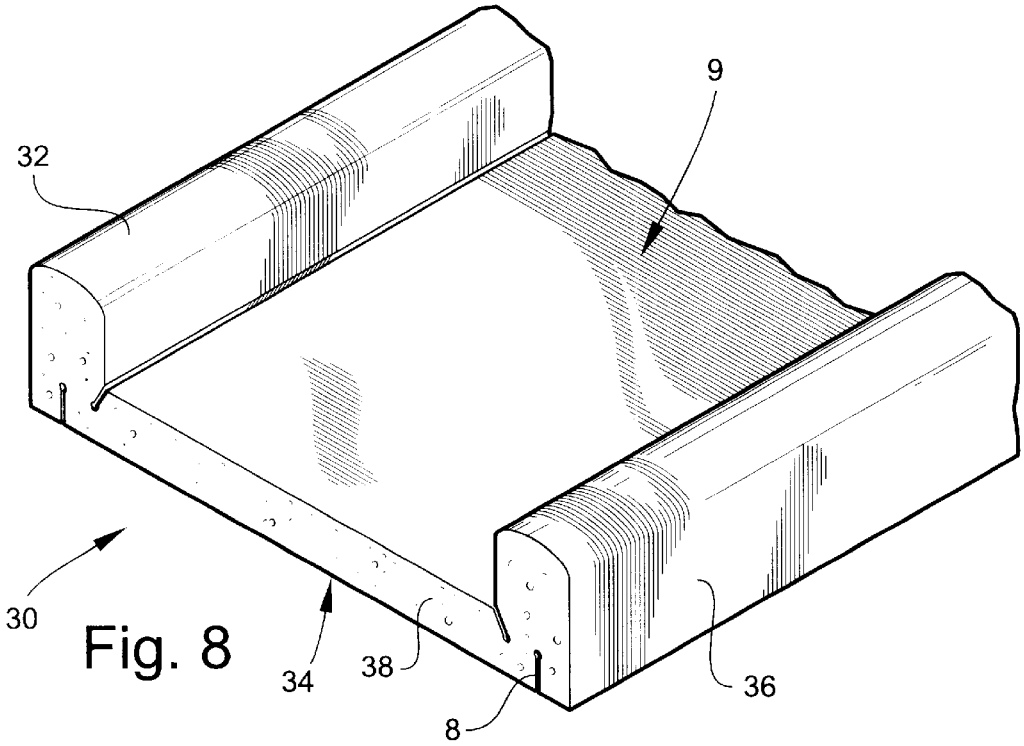
FIG. 8 is a perspective view of a cornice channel body according to the present invention.
Figure 9:
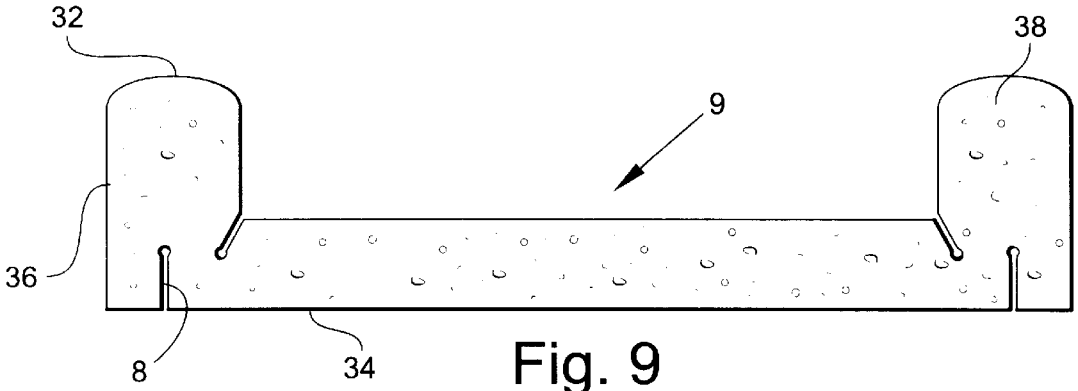
FIG. 9 is an end view of the cornice channel body according to the present invention.
Figure 10:
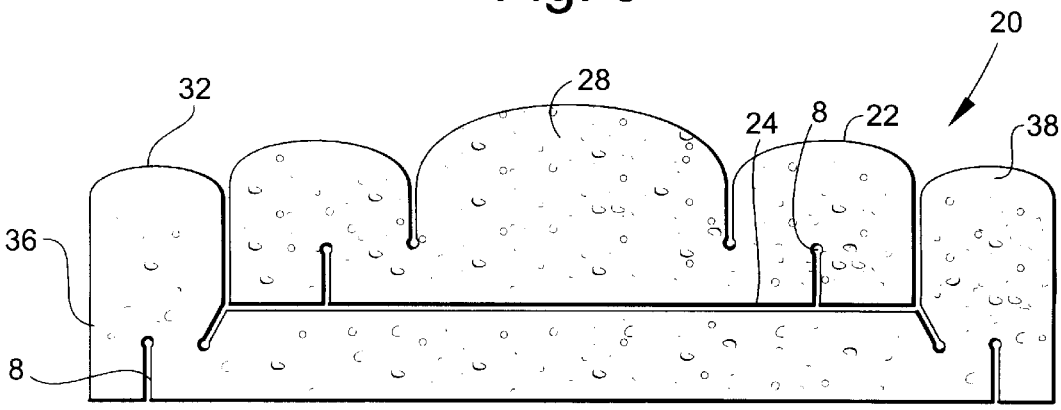
FIG. 10 is an end view of the cornice channel body having a cornice relief body inserted into the relief body channel.
Figure 11:
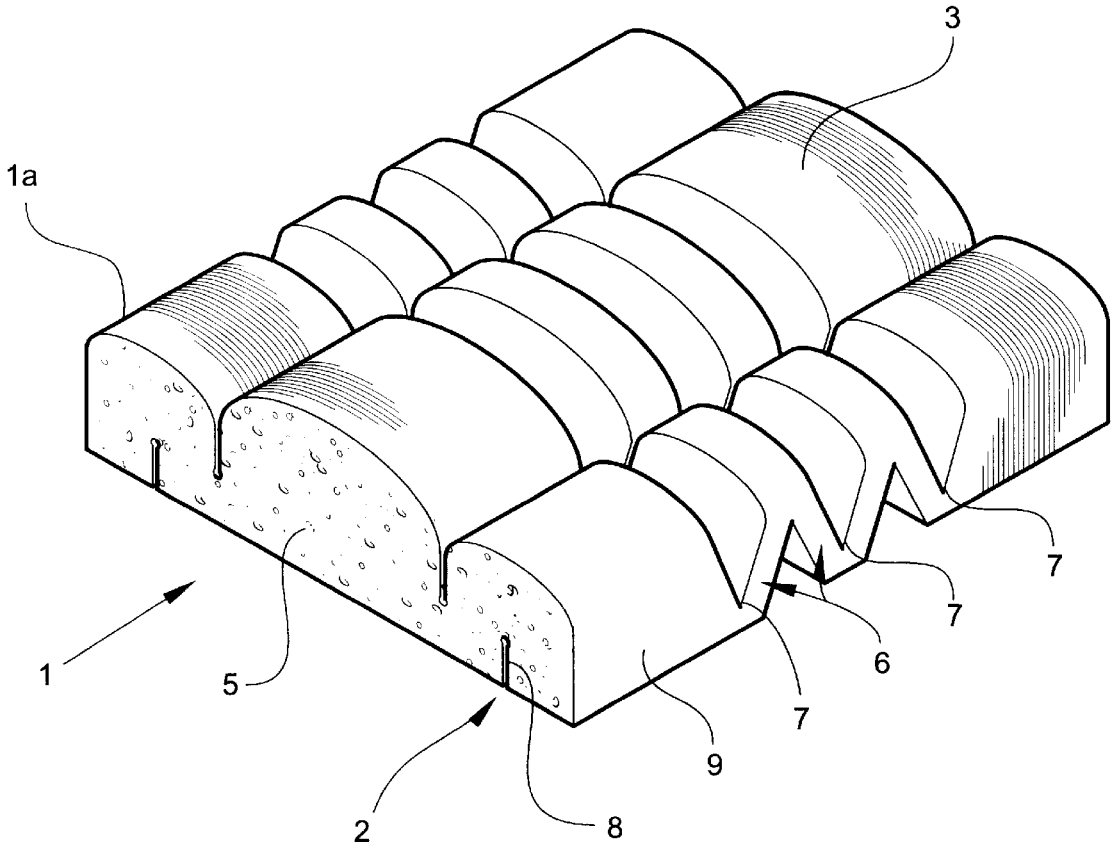
FIG. 11 is a perspective view of the joint for a cornice relief body according to the present invention, showing the slits on the bottom of the joint.

The joint has flat ends 5 that are designed to match with and attach to a window treatment. FIG. 1 illustrates a joint 1 that attaches to a cornice relief body 20 that also has a top 22, a bottom 24, two sides 26, and two ends 28. FIG. 2 illustrates a joint 1 that attaches to a cornice channel body 30 that also has a top 32, a bottom 34, two sides 36, and two ends 38. Thus, ends 5 of joint 1 will match either ends 28 or ends 38 depending upon whether a cornice relief body 20 is being used or a cornice channel body 30 is being used, generally referred to as 1*a* and 1*b*. Further, both a cornice relief body joint la and a cornice channel body joint 1*b* may be used, as illustrated in FIG. 10.

Longitudinal slots 40 are provided in the cornice relief body joint 1*a* to provide a place for fabric to be inserted, or tucked into. Likewise, Longitudinal slots 42 are provided in the cornice channel body joint 1*b* to provide a place for fabric to be inserted, or tucked into when the cornice channel body 30 is used for decoration without inserting a cornice relief body 20. When the cornice relief body 20 is being used with the cornice channel body 30, i.e., the relief body 20 is inserted into the channel of the relief body 30, the fabric may be inserted into, or tucked between, the abutting, or adjacent areas.

It is preferred that the ends 5 be attached to ends 28 or 38 by a sprayable contact cement, adhesive, or glue. However, double-sided sticky tape may also be used and still falls within the scope of the present invention.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A joint for use in cornice window treatment applications comprising:

a) an elongate body having a top, a bottom, two sides extending between the top and bottom, and two ends located at opposite parts of the body along the longitudinal direction;

b) at least one slit perpendicular to the longitudinal direction of the body forming an incised angle incised into the top of the body;

c) at least two slits incised into the bottom of the body along the longitudinal direction for the insertion of fabric;

said body further being made from a soft, yielding material that allows bending of the body thereby opening the incised angle of the at least one perpendicular slit.

2. The joint as in claim 1 wherein a relief body is attached to each end of the joint, respectively.

3. The joint as in claim 1 wherein the joint further has a channel located in the top of the joint for receiving a second inserted joint.

4. The joint as in claim 3 wherein the joint further has a channel body attached to each end of the joint, respectively.

5. A joint for use in cornice window treatment applications comprising:

a) an elongate body having a top, a bottom, two sides extending between the top and bottom, and two ends located at opposite parts of the body along the longitudinal direction;

b) at least two slit perpendicular to the longitudinal direction of the body forming an incised angle, at least one of the slits being incised into the top of the body and at least one of the slits being incised into the bottom of the body;

c) at least two slits incised into the bottom of the body along the longitudinal direction for the insertion of fabric;

said body further being made from a soft, yielding material that allow bending of the body at said perpendicular slits.

6. The joint as in claim 5 wherein a relief body is attached to each end of the joint, respectively.

7. The joint as in claim 5 wherein the joint further has a channel located in the top of the joint for receiving a second inserted joint.

8. The joint as in claim 7 wherein the joint further has a channel body attached to each end of the joint, respectively.

* * * * *